United States Patent [19]

Dombrowski

[11] 4,047,405

[45] Sept. 13, 1977

[54] APPARATUS FOR APPLYING DYE LIQUOR TO KNIT/DEKNIT TUBULAR ROLLS

[75] Inventor: Edward J. Dombrowski, Asheboro, N.C.

[73] Assignee: Champagne-Dye Works, Asheboro, N.C.

[21] Appl. No.: 732,091

[22] Filed: Oct. 13, 1976

[51] Int. Cl.[2] ..... D06B 1/02; D06B 11/00

[52] U.S. Cl. ..... 68/205 R; 28/218; 134/99

[58] Field of Search ..... 68/200, 201, 205 R, 68/206, 207; 28/72.16; 118/315; 8/149; 134/95, 99, 102

[56] References Cited

U.S. PATENT DOCUMENTS

| | | | |
|---|---|---|---|
| 1,915,779 | 6/1933 | Gere | 68/205 R |
| 1,932,913 | 10/1933 | Schieber et al. | 68/205 R |
| 3,141,618 | 7/1964 | Haas | 134/99 X |
| 3,579,679 | 5/1971 | Willis | 68/205 B X |

FOREIGN PATENT DOCUMENTS

| | | | |
|---|---|---|---|
| 641,753 | 7/1962 | Italy | 134/99 |

*Primary Examiner*—Philip R. Coe

[57] ABSTRACT

One or more containers of dye liquor under pressure are connected by a supply line carrying dye liquor from each container to a dye fixture on which are successively positioned rolls of knit tubular fabric which is to be deknit subsequently to form textured yarn. A plurality of generally parallel, spaced tubular elements having spaced dye outlet openings therein are so arranged to form a horizontal support surface with the dye openings facing upwardly toward the exposed side of the knit tubing roll. Dye liquor from each container is carried through one of the supply lines into a corresponding header or manifold. The tubular elements are so arranged to be connected to one of the headers. A control valve in the supply lines is selectively activated to cause a surge of pressure in the tubular elements so that a plurality of spaced jets of dye liquor are emitted through the openings onto or into the adjacent side surface of a knit tubing roll positioned on or near the upper surface.

6 Claims, 5 Drawing Figures

APPARATUS FOR APPLYING DYE LIQUOR TO KNIT/DEKNIT TUBULAR ROLLS

BACKGROUND OF THE DISCLOSURE

Recent developments in space dyeing, as disclosed in my co-pending application Ser. No. 664,553, filed Mar. 8, 1976, and now abandoned, relate to a dyeing process in which a roll of knit, tubular-shaped prefabric, the first stage of a knit-deknit process, is presented to a dye station while in the rolled package. Dye liquor is applied to spaced areas on the side surfaces of the roll in such amounts as to form, at least initially separate and distinct regions of dye which spread both transversely into the roll and in all directions throughout a plurality of convolute layers. The dye and crimp is subsequently heat set in an autoclave and the tube is deknitted according to conventional practices to provide a textured or crimped yarn having various types of unique, random color variations. Further such a dyeing technique accelerates the dyeing operation to such an extent that the cost per pound of dyeing is reduced to make space dyed yarn much more economical than at present and also desirable for additional uses not possible before.

During the above-described operation, it is necessary to apply dye liquor to the side surfaces of the knit/deknit tubing package. It is important in such techniques to be able to control the amount of dye liquor applied, so that the resulting fabric will have lighter or darker overall tones, as desired. Further the amount of dye liquor introduced into the roll of knit tubing and the points of application of such dye liquor in repeated operations must be controlled to insure consistency of the pattern from roll to roll, even though the resulting fabric pattern, which is formed after the yarn is deknit, appears in some cases to be random. In other cases where the one color is used to cover an entire side, the application of dye must be such as to spread from the initial points of application to evenly cover an entire side.

Other desirable features of any apparatus used in performing the technique described hereinabove would include a single point of activation, as well as flexibility in the dye fixture, so that patterns can be varied as desired.

SUMMARY OF THE INVENTION

The present invention, therefore, is directed to an apparatus or dye station which includes a dye fixture where the rolled tubular fabric is positioned and dyed; a plurality of pressurized containers, each having a selected color or type of dye liquor therein; a supply line leading from each container to one of a plurality of manifolds or headers at the dye fixture; and an activating means for selectively applying the dye liquor to the tubular rolled knit fabric. The dye fixture itself includes a plurality of tubular elements so arranged as to form a horizontal, planar, raised support surface. The tubular elements each include at least one open end through which dye liquor is introduced, and a plurality of spaced outlet openings along the upper surface thereof directed upwardly. The aforementioned headers each receive a supply of dye liquor of one type or color and emit such dye liquor upon activation of the activating means through a plurality of outlet nipples. Depending on the pattern desired, dyestuff of the same or of different colors can be applied to the different headers. Also, the pressure can be adjusted so that as dyestuff is applied, it spreads to completely color one entire side surface of the coil of knit tubing. A flexible tubing connects each outlet nipple with the open end of one of the tubular elements for transmitting the dye liquor to preselected spaced areas through the tubular elements.

It is therefore an object of the present invention to provide an apparatus or dye station whereby dye liquor may be applied to spaced points on the undersurface of a roll or coil of knit tubular fabric in such prescribed amounts as to form, at least initially separate and distinct dyed regions which spread in all directions through a plurality of convolute layers of the fabric.

It is another object of the present invention to provide an apparatus of the type described in which the work piece is supported in operative communication on a grill-like surface of the dye fixture, yet is maintained out of contact with any flat type of support surface on which dye liquor could accumulate and distort the dye application pattern.

It is still a further object of the present invention to provide an apparatus of the type described in which the amount and point of application of the dye liquor can be easily controlled, so that a roll-to-roll color application can be substantially repeated.

Other objects and a fuller understanding of the invention will become apparent from reading the following detailed description of a preferred embodiment along with the accompanying drawings in which.

DETAILED DISCLOSURE OF THE PREFERRED EMBODIMENT

Figure 1:
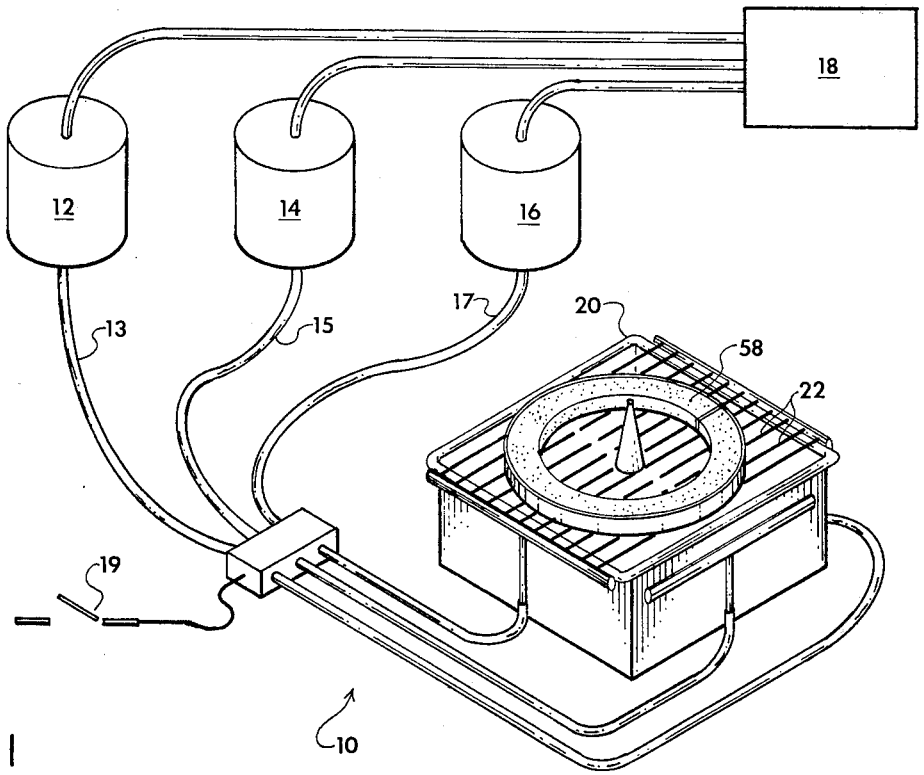
FIG. 1 is a schematic representation of the dye station according to the present invention.
Figure 2:
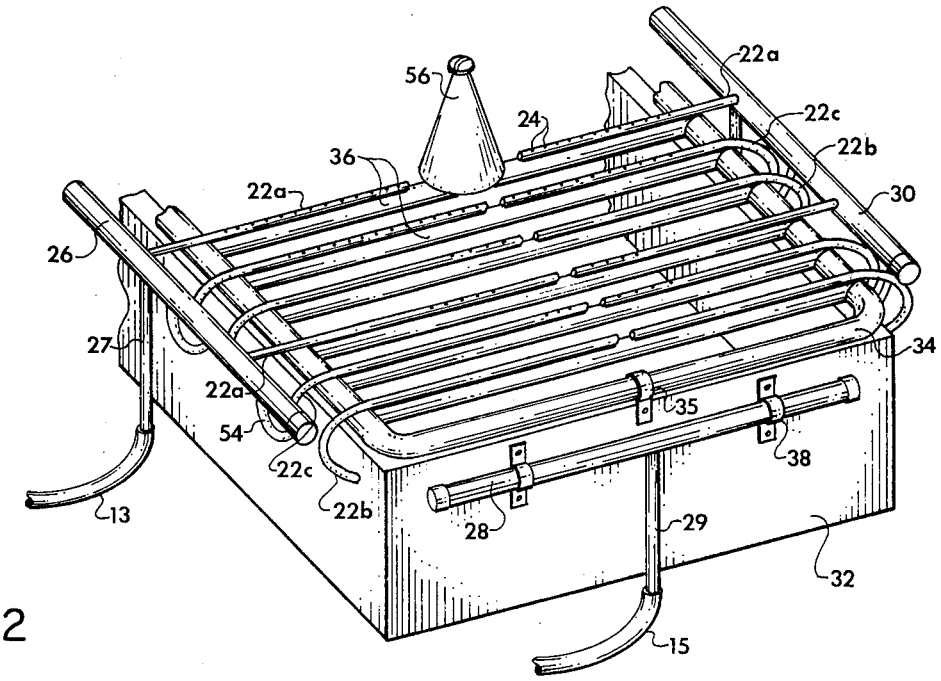
FIG. 2 is a perspective view, with approximately one-half cut away, illustrating the dye fixture according to the present invention.
Figure 3:
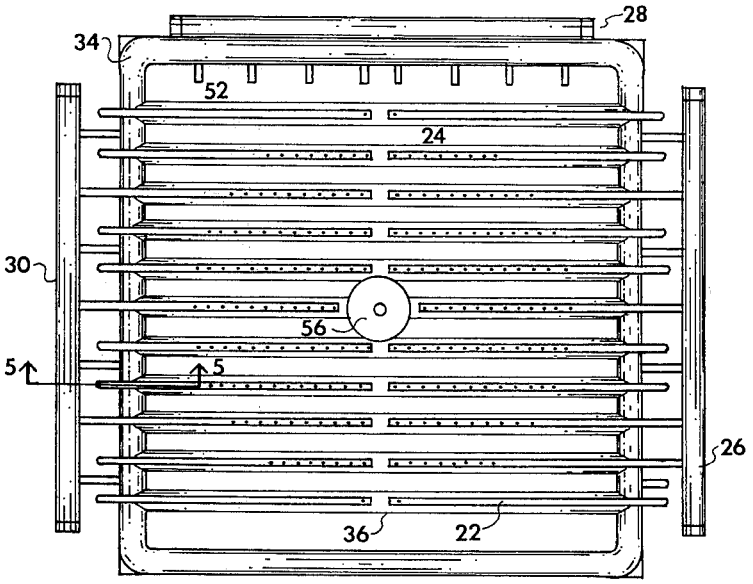
FIG. 3 is a plan view of the dye fixture according to the present invention.

Turning now to a more detailed description of a preferred embodiment of the present invention, there is illustrated in FIG. 1 an apparatus for applying dye to spaced positions on the circular side surfaces of a roll of knit fabric which is subsequently to be deknit. In general the apparatus includes a dye station 10 provided with a plurality of pressurized containers 12, 14, 16, each containing a supply of dye liquor therein; a supply line 13, 15, 17 extending from each of the containers 12, 14, 16 to a dye fixture 20; a means 18 for applying pressure to the dye in each of said containers to force it out of said supply lines; and a valve means 19, selectively operable for opening said supply lines and causing a plurality of dye jets to be emitted upwardly from the surface of said dye fixture 20. The dye fixture 20 itself includes a plurality of tubular elements 22 arranged to form a horizontally planar surface pattern. Each element 22 includes spaced dye outlet openings 24 in the upper surface thereof and is connected to one of the supply lines 13, 15, 17 through a corresponding header member 26, 28, 30, suitably attached to the side of dye fixture 20. Each header 26, 28, 30 receives dye liquor from one of the pressurized containers 12, 14, 16, and thereby transmits such dye liquor to the corresponding tubular element 22, so that a desired, dye pattern can be achieved.

Turning now to a more specific description of the dye fixture 20, itself, there is illustrated in FIGS. 2–5 several views of a preferred embodiment of dye fixture, which has proven to be satisfactory in achieving the dyeing techniques described hereinabove. A rectangular frame 32, which may be wooden, or any other desired material includes a support frame or grill 34 secured to the top edge thereof by conventional, commercially available clamps 35. The rectangular base or frame 32 does not have a bottom or top for reasons to be hereinafter described. The upper support frame or grill 34 is preferably of a tubular metallic material to which tubular elements 22 may be tackwelded. Further, support frame 34 includes a plurality of spaced cross members 36 which actually support tubular elements 22. So arranged, it is easily seen that there is assembled on top of the rectangular framework the support frame 34 in the shape of a grill having a plurality of spaced support members 36 with openings therebetween so that excess dye liquor can escape thereunder.

A plurality of tubular elements 22 are attached to the upper surface of cross members 36 by tackwelding, or other conventional methods. Each of the tubular elements 22 extend approximately halfway across the space between the sides of frame 32 and terminate near the mid-portion thereof. The reason for this is so that dye liquors of different color can be provided on either side of the centerline. Each tubular element includes one or more openings 24 in the upper surface thereof to allow dye liquor to escape when the valve 19 is activated. Openings 24 may, if desired in an alternate embodiment, be equipped with needles, so that dye may be injected internally of the knit tubing package.

Figure 4:
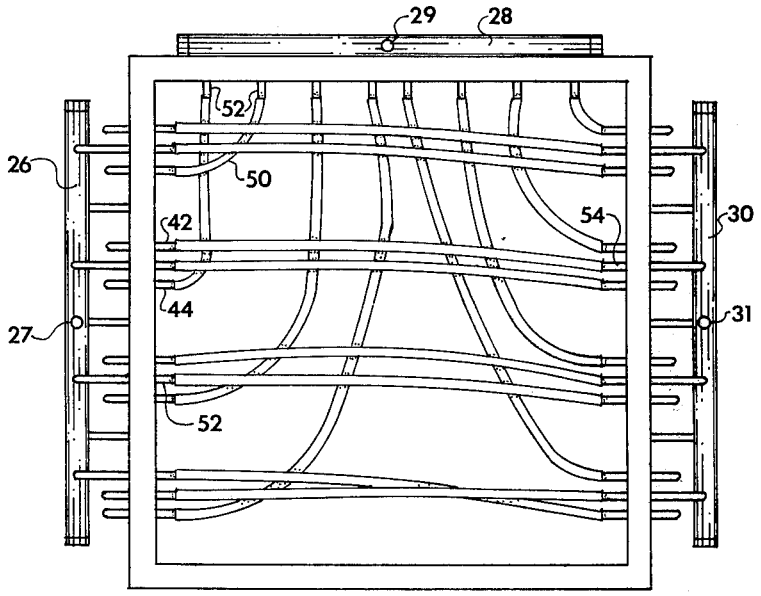
FIG. 4 is a plan view looking at the underside of the dye fixture according to the present invention.
Figure 5:
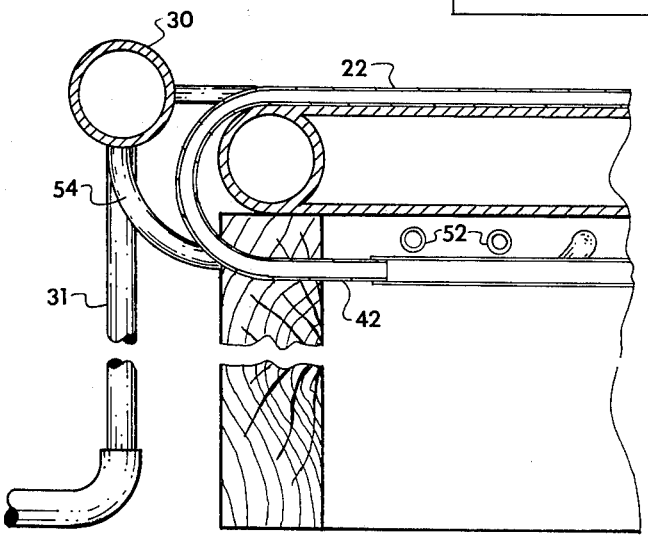
FIG. 5 is a sectional view taken substantially along lines 5—5 in FIG. 3.

The inner end of each tubular element 22, or the end nearest the center portion of the horizontally planar dye surface are sealed so that the dye liquor cannot escape therethrough. The outer end, or opposite ends from the inner ends, are arranged in one of two different ways. Some of the outer ends (as illustrated at **22*a*) lead directly into the adjacent header 26 or 30. Other ends 22*b* and 22*c* are curved around and extend through openings in the side walls of rectangular frame 32 to form terminal ends 42, 44 as illustrated in FIGS. 4 and 5. As is further illustrated in FIG. 4, some of the ends 42, 44 which extend through the side wall of housing 32 are attached by means of flexible conduit 50 to nipples 52 leading from header 28 and extending through the end wall of rectangular frame 32 to receive dye liquor from header 28. Other of the terminal ends 42, 44 are attached to nipples 54 extending from the header 26 or 30 on the opposite side, so that dye liquor from one header may be introduced through conduits 22 on the other side thereof. The flexible tubing 50 can be rearranged as desired so that any desired pattern of dye application can be formed. The set up illustrated in FIGS. 4 and 5** are exemplary of only one possible pattern to be achieved in which three colors are distributed in a relatively even pattern.

Looking now at the headers 26, 28, and 30, each header includes an entrance conduit 27, 29, 31 respectively through which dye liquor from one of the supply tubes 13, 15, 17 is introduced into the corresponding header. The dye liquor from any one header is then supplied to the tubular elements 22 either directly as in the case of the type illustrated by tubular element **22*a*, or through a nipple 54 or 52 which extends through the housing and is connected to one of the tubular elements 22*b*, 22*c* on an opposite or adjacent side of the housing 32 by means of a length of flexible conduit 50**. As can be easily seen a very satisfactory program of dye patterns can be thereby achieved.

A conical shaped positioning spindle 56 is centrally located on the grill work formed by the support frame 34 and cross members 36 and extends upwardly therefrom. Rolls of knit tubing which have a hollow core are then laid onto the positioning element 56 so that one side thereof is positioned adjacent the openings 24 in the tubular elements 22 through which dye is introduced selectively by means of operation of a valve or foot pedal 19. A protective, annular shaped, foam shield 58 is provided to surround the knit roll after it is positioned, so that dye liquor is not inadvertently emitted through an opening 24 which might not be covered by the roll of knit fabric.

The containers 12, 14 and 16 are each pressurized as set forth hereinabove in a conventional, well-known manner, such as by applying compressed air 18 through the cover or lid thereof to insure adequate pressure on the dye liquor therein at all times. By varying the pressure, time that the pedal or valve 19 is opened, or the positioning of the knit roll of tubing on the fixture relative to the opposite side, the possible combinations and patterns which might be achieved are almost infinite.

Tubular elements 22 have been illustrated and described as being laid out in a pattern of straight, parallel, spaced tubes. It should be apparent that many variations to this pattern are possible, such as a series of concentric circles, a serpentine path, a sine wave or series of sine waves, or others.

Although a preferred embodiment is described hereinabove, it is evident that other modifications and changes might be made to the specific structure illustrated without departing from the scope of the invention, which is to be limited only by the following claims:

What is claimed is:

1. Apparatus for applying dye to spaced positions on the side surfaces of a roll of knit fabric which is to subsequently be deknit to form a crimped yarn comprising:

a. a dye fixture including support means for holding at least one of said rolls in close relation thereto;

b. a plurality of containers, each adapted to receive a supply of dye liquor therein;

c. a supply line extending from each of said containers to said dye fixture;

d. means for applying pressure to the interior of each of said containers to force the dye liquor out into said supply lines under pressure;

e. said dye fixture comprising a plurality of tubular elements arranged in a horizontally planar configuration and having spaced dye outlet openings in the upper surface thereof, and means for connecting each of said tubular element to one of said supply lines for selectively receiving dye under pressure therefrom; and f. valve means selectively operable for opening said supply lines and causing a plurality of spurts of dye liquor to be emitted upwardly through the openings in said tubular elements.

2. The apparatus according to claim 1 wherein said means for connecting said tubular elements to said supply lines comprises a plurality of manifolds attached to said dye fixture, each of said manifolds connected to one of said supply lines for receiving dye liquor therefrom and including a plurality of outlet nipples, and flexible tubing connecting some of said outlet nipples with preselected ones of said tubular elements.

3. The apparatus according to claim 2 wherein said tubular elements extend from an outer end at opposite sides of said fixture toward the opposite side and terminating in a closed inner end adjacent the centerline between the two opposite sides, a first group of said outer ends being connected directly into one of the manifolds positioned adjacent thereto, a second group of said outer ends being connected by said flexible tubing to the outlet nipples of a second manifold positioned on the opposite side of said fixture, and a third group of said outer ends being connected to the outlet nipples of a third manifold positioned on an adjacent side of said fixture.

4. The apparatus according to claim 1 wherein said support means comprises said plurality of tubular elements and a positioning spindle extending upwardly from the center of said planar configuration of said tubular elements.

5. The apparatus according to claim 4 wherein said dye fixture includes a rectangular, hollow framework, a support grill attached to the framework, said tubular elements being attached along the upper surface of said grill whereby said grill acts as a spacer.

6. The apparatus according to claim 5 wherein said grill comprises a plurality of spaced parallel cross-members, and said tubular elements are arranged in a corresponding pattern atop said cross-members.

* * * * *